United States Patent [19]

Asper et al.

[11] Patent Number: 4,710,984

[45] Date of Patent: Dec. 8, 1987

[54] HELMET FOR PROTECTION AGAINST IMPACTS AND A METHOD OF MANUFACTURING THE SAID HELMET

[75] Inventors: Jean-Jacques Asper, Croix De Rozon, Switzerland; Rémi Cottenceau, Viry, France

[73] Assignee: Motul S.A., Aubervilliers, France

[21] Appl. No.: 847,901

[22] PCT Filed: Jun. 14, 1985

[86] PCT No.: PCT/CH85/00098

§ 371 Date: Feb. 14, 1986

§ 102(e) Date: Feb. 14, 1986

[87] PCT Pub. No.: WO86/00198

PCT Pub. Date: Jan. 16, 1986

[30] Foreign Application Priority Data

Jun. 18, 1984 [CH] Switzerland ..... 2942/84

[51] Int. Cl.[4] ..... A42B 3/02

[52] U.S. Cl. ..... 2/412; 2/414

[58] Field of Search ..... 2/412, 411, 410, 425, 2/424, 420, 6, 414, 10

[56] References Cited

U.S. PATENT DOCUMENTS

| | | | |
|---|---|---|---|
| 3,039,108 | 6/1962 | Lohrenz | 2/412 |
| 3,248,738 | 5/1966 | Morgan | 2/414 |
| 3,286,275 | 11/1966 | Marchello | 2/411 |
| 3,465,363 | 9/1969 | Raney | 2/420 |
| 3,935,044 | 1/1976 | Daly | 2/412 X |
| 4,006,496 | 2/1977 | Marker | 2/414 |
| 4,075,717 | 2/1978 | Lemelson | 2/412 |
| 4,134,155 | 1/1979 | Robertson | 2/412 |

FOREIGN PATENT DOCUMENTS

| | | |
|---|---|---|
| 2133215 | 1/1972 | Fed. Rep. of Germany . |
| 7837986 | 3/1979 | Fed. Rep. of Germany . |
| 3005001 | 8/1981 | Fed. Rep. of Germany . |
| 3314924 | 9/1984 | Fed. Rep. of Germany . |
| 2340066 | 9/1977 | France . |
| 2379262 | 9/1978 | France . |
| 2473855 | 7/1981 | France . |
| 1578351 | 11/1980 | United Kingdom . |

*Primary Examiner*—Peter Nerbun

*Attorney, Agent, or Firm*—Cushman, Darby & Cushman

[57] ABSTRACT

This helmet comprises an outer protective shell, an impact-absorbing layer made from a non-elastically compressible material, and a layer of elastically compressible material. A dome is interposed between the said layer and the impact-absorbing layer. The said dome is obtained by hot-drawing a 0.3 to 0.7 mm sheet material, of which the modulus of elasticity is between 1800 and 3500 N/mm$^2$, the elongation at rupture less than 100% and the ultimate tensile strength between 30 and 100 N/mm$^2$.

4 Claims, 1 Drawing Figure

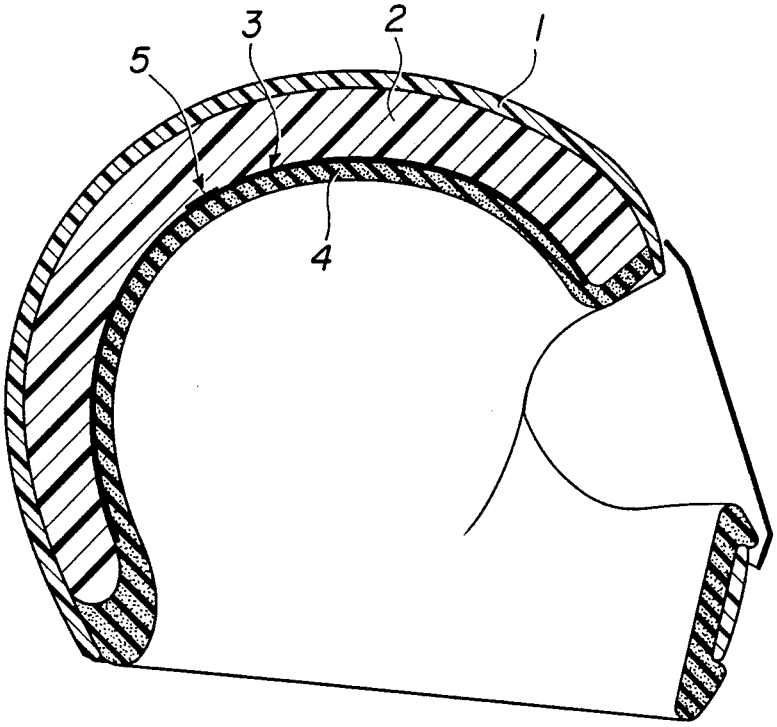
5
3
2
1
4

HELMET FOR PROTECTION AGAINST IMPACTS AND A METHOD OF MANUFACTURING THE SAID HELMET

The present invention relates to a helmet for protection against impacts, comprising an outer protective shell, a layer made from a non-elastically compressible material for absorbing the energy of the impact, an elastically compressible layer forming the inner surface of the helmet, and an intermediate layer between the two preceding layers for distributing the pressure exerted on both sides of a portion of the layer for absorbing the energy of the impact over a larger portion of the same layer.

Helmets of this type are already known which are designed in particular to protect motorcyclists and moped riders. One helmet of this type is described in the patent U.S. Pat. No. 4,064,565. According to this patent, the intermediate layer, which is designed to distribute the pressures exerted on both sides of the impact-absorbing layer, is formed by a fluid or an incompressible gel, which is covered externally by a semi-rigid envelope. The use of a liquid or a gel presupposes its encapsulation in a highly resistant membrane which can be elastically deformed. In the solution described in the said document, the liquid or gel is in fact encapsulated in the form of small globules, from which a layer having the required thickness is formed. When the said layer is deformed, the pressure is distributed at the level of the semi-rigid envelope, the latter then transferring the pressure distributed in this manner to the impact-absorbing layer. The manufacture of the distribution layer formed from an encapsulated liquid or gel is very expensive. Furthermore, its efficiency is dependent upon a certain thickness, which thus increases the overall volume of the helmet, the absorption layer also requiring a thickness which is sufficient in order to absorb a level of energy determined by the official safety standards in the majority of countries.

Another solution proposed by N0. FR-A-2 340 066 consists in arranging the impact-absorbing layer between two rigid shells formed from reinforced plastics material. The use of a rigid inner shell necessitates the presence of a shock-absorbing layer and an elastically compressible comfort layer inside the said rigid inner shell. This is a solution which requires three layers between the head and the layer for absorbing the impacts, which gives rise to a problem of bulkiness. Furthermore, the presence of a rigid inner shell is an inconvenience in respect of comfort. The increase in the number of layers also increases the cost of manufacturing the helmet.

In U.S. Pat. No. 4,075,717, a helmet is proposed which is formed by a hollow structure defined by two walls, inner and outer respectively, which are in the shape of the helmet, and between which an expansible plastics material is injected. It is specified in this document that the inner and outer walls may be of different materials, i.e. that the inner wall is preferably formed from a more flexible material, whilst the outer wall is formed from a material having a high impact strength. In spite of these measures, the displacement of the inner wall is limited on account of its connection to the outer wall, such that a helmet of this type cannot benefit from the maximum potential impact-absorbing effect of the expanded plastics material. An approximately equivalent solution is described in U.S. Pat. No.3,935,044, wherein the outer shell is welded to the inner stress-distributing shell after the absorption layer has been moulded and expanded on the inner shell. Once again, the inner shell is integral with the outer shell and is therefore not free to move under the effect of an impact, such that the efficiency of the absorption layer is not utilised to the maximum.

The object of the present invention is to significantly increase the impact-absorbing effect of the helmet by means of an improved distribution of the stressed, which at the same time does not have the inconveniences of the above solutions.

To this end, the subject of the present invention is a helmet for protection against impacts comprises an outer protective shell, an impact-absorbing layer made from a non-elastically compressible material, and a layer of elastically compressible material. A dome is interposed between the said layer and the impact-absorbing layer. The said dome is obtained by hot-drawing a 0.3 to 0.7 mm sheet material, of which the modulus of elasticity is between 1800 and 3500 $N/mm^2$, the elongation at rupture less than 100% and the ultimate tensile strength between 30 and 100 $N/mm^2$.

On account of the characteristics of the semi-rigid shell disposed on the inner surface of the absorption layer, the distribution of the impact is improved to such an extent that the absorptive capacity of the same absorption layer increases by over 40%. It is quite surprising that the said semi-rigid shell has an ideal thickness of 0.35 mm, i.e. it has a negligible volume and results in an extremely small increase in cost, since it can be produced by simple heat-deformation of a sheet of thermoplastic material. It has in fact been established, as will be shown below, that the efficiency of the intermediate distribution layer according to the invention is equivalent to that which can be obtained by means of the solutions of the prior art, without increasing the volume of the helmet and for an extremely small additional cost. This efficiency is essentially due to the mechanical characteristics of the dome, and to the fact that the said dome is free with respect to the outer shell, such that, under the effect of an impact, it behaves in the manner of a piston which compresses the layer of non-elastically deformable material.

The single FIGURE of the attached drawing shows diagramatically and by way of example, a cross-section through an embodiment of the helmet for protection against impacts which is the object of the present invention.

The helmet is formed from a rigid outer shell 1, made of a hard plastics material such as moulded ABS. On the inside of the said shell there is an impact-absorbing layer 2 of expanded polystyrene, having a density of 33 g/l, the thickness of which lies between 27 and 31 mm in the case of the example considered, and taking into account the official standards currently in force. However, as will be seen below, this thickness may be reduced, taking into account the results of the tests carried out with the helmets according to the invention. A semi-rigid dome 3 is adhered at least in a zone 5 situated in the region of the center of the dome. The said dome is made from a sheet of thermoformed hard PVC by holding the sheet at the edge and by hot-drawing it under vacuum over a mould which corresponds to the shape of the skull, and which exactly matches the inner surface of the impact-absorbing layer 2. As will be seen below, the mechanical properties of the said dome are decisive for obtaining the effect of distributing the impacts over the impact-absorbing layer 2. The hard PVC used to manufacture the said dome 3 has a modulus of elasticity of $E=2500\ N/mm^2$, an elongation at rupture of $\Delta 1=20\%$ to 30% and an ultimate tensile strength $\sigma_R$ of 54 $N/mm^2$. The choice of dimensions will be discussed at the time of the analysis of the tests carried out.

The inner surface of the said semi-rigid dome 3 is covered by an elastically compressible layer 4 of polyurethane foam having a thickness of between 5 and 15 mm, which is covered on the inside by a fabric for keeping it clean, which is not shown. The latter elastically compressible layer 4 is solely intended for comfort, in order to reduce the hardness of the other layers which form the helmet.

The helmet for protection against impacts described above was subjected to a series of tests carried out under the following conditions.

A mass of 4 to 5 kg representing a false head is placed inside the helmet and an accelerometer fixed at the center of gravity of the mass is connected to a recording device. The whole, weighing between 5 and 6 kg, is mounted at the end of a fixed arm which is integral with a horizontal bar, the two ends of which are mounted so as to slide along two taut vertical cables. The mass, which represents the head, can be guided into a predetermined position at the end of the arm with a view to presenting the helmet according to the required position for the impact test. In the tests carried out, the mass was positioned such that impact would take place at 43 mm from the front edge of the helmet and along a centre plane.

The height of the fall was selected at 2.6 m above a flat anvil, such that the speed at the point of impact would be 7 m/s. These tests were carried out with impact-absorbing layers 2 having thicknesses of to 27 and 31 mm respectively, and at ambient temperature. Each of the said layers was associated with three types of semi-rigid domes 3 made from 0.3, 0.5 and 0.7 mm sheets. Following thermoforming, the said semi-rigid domes 3 have a thickness corresponding approximately to $\frac{2}{3}$ of the initial thickness of the sheet.

Table 1 below shows the average results in grams, corresponding to the gravitational acceleration recorded at the time of the various tests.

TABLE 1

| Thickness of impact-absorbing layer | 27 mm | 31 mm |
|---|---|---|
| Helmet without cap 3 | 300 g | 212 g |
| Helmet with cap 3 PVC sheet 0.3 mm | 178 g | 115 g |
| Helmet with cap 3 PVC sheet 0.5 mm | 152 g | 121 g |
| Helmet with cap 3 PVC sheet 0.7 mm | 166 g | 147 g |

The values indicated in this table are the average values from the maxima of five tests carried out with five helmets.

The semi-rigid domes 3 formed from 0.3 mm sheets of hard PVC, which are approximately 0.2 mm after thermoforming, break or are deformed and only partially distribute the energy of the impact. The semi-rigid domes 3 formed from 0.5 mm sheets of hard PVC, which are approximately 0.35 mm after thermoforming, are not deformed and act within the absorption layer 2 in the manner of a piston. In the case of a dome 3 formed from a 0.7 mm sheet of hard PVC, the same is observed as in the case of the 0.5 mm sheet. It is thus established that, in both cases, the energy of the impact is correctly transmitted with optimum distribution, since the semi-rigid dome is neither deformed nor broken. This behaviour shows that the energy of the impact is distributed in a uniform manner owing to the presence of the semi-rigid dome, the remainder only depending upon the nature and the parameters of the impact-absorbing layer 2.

One factor which was found to be important during the tests is that of maintaining the position of the semi-rigid dome 3 relative to the impact-absorbing layer 2. For this reason, it is strongly recommended to render the two elements integral by adhering them to one another. A single spot adherence using contact adhesive, as indicated by reference 5, is quite sufficient in order to prevent displacement of the dome 3 under the effect of the impact.

Although only examples made from hard PVC have been referred to in the above, it is conceivable to use other thermoplastic materials such as ABS, the modular elasticity of which is also 2450 $N/mm^2$, the elongation at rupture being 20% and the ultimate tensile strength 47 $N/mm^2$, or PETP (PE terephthalate), the modulus of elasticity of which is 2800 $N/mm^2$, the elongation at rupture between 50% and 70%, and the ultimate tensile strength 73 $N/mm^2$. Among other materials which could be used, it is possible to cite, by way of non-limiting example, the materials listed in table II below:

TABLE II

| | E ($N/mm^2$) | $\sigma R$ ($N/mm^2$) | 1 (%) |
|---|---|---|---|
| cellulose acetate | — | — | — |
| $PA_{66}$ (Polyamide) | 1960 | 80–90 | 30–50 |
| PMMA (Polymethyl methacrylate) | 3200 | 72 | 4–12 |
| PS (polystyrene) | 3450 | 48 | 2–3 |
| PVAC (copolymer of PVC) | — | 39–57 | 3–100 |
| PC (polycarbonate) | 2160 | 63–68 | 65–100 |

These values are the values of the plastics material sheet prior to thermoforming by hot-drawing and not the values measured on the semi-rigid dome 3 per se. Hard PVC is the preferred choice on account of its mechanical properties, its cost, and its good thermoformability. In general, the material used for the semi-rigid dome 3 is preferably a hot-drawn thermoplastic, of which the mechanical properties prior to drawing, i.e. those of the flat material in sheet form, are between 1800 and 3500 $N/mm^2$ for the modulus of elasticity, between 30 and 100 $N/mm^2$ for the ultimate tensile strength, and less than 100% for the elongation at rupture.

We claim:

1. A helmet for protection against impacts, comprising a rigid outer protective shell, a first layer made from a non-elastically compressible material for absorbing the energy of the impact, an elastically compressible second layer forming the inner surface of the helmet, and an intermediate layer disposed between the two preceding layers for distributing the pressure exerted on both sides of a portion of the first layer for absorbing the energy of the impact over a large portion of the first layer, characterized in that the said intermediate layer is formed by a semi-rigid dome, which is independent of the outer protective shell and which is formed from a sheet material of 0.3 to 1 mm thickness, of which the modulus of elasticity is between 1800 and 3500 $N/mm^2$, the elongation at rupture less than 100% and the ultimate tensile strength between 30 and 100 $N/mm^2$.

2. A helmet according to claim 1, characterized in that a central portion of the said semi-rigid shell is secured to the first layer.

3. A helmet according to claim 1, characterized in that the said semi-rigid shell is made from hard PVC.

4. A helmet according to claim 1, characterized in that the said dome is hot drawn from a sheet of thermoplastic material.

* * * * *